US007001157B2

(12) United States Patent
Xiaoxi

(10) Patent No.: US 7,001,157 B2
(45) Date of Patent: Feb. 21, 2006

(54) WELL PUMPING UNIT DRIVEN BY LINEAR MOTOR

(75) Inventor: Zhou Xiaoxi, Beijing (CN)

(73) Assignee: "Castles" Home Services Inc., Springfield, IL (US)

( * ) Notice: Subject to any disclaimer, the term of this patent is extended or adjusted under 35 U.S.C. 154(b) by 315 days.

(21) Appl. No.: 10/469,070

(22) PCT Filed: Feb. 25, 2002

(86) PCT No.: PCT/US02/06151

§ 371 (c)(1),
(2), (4) Date: Aug. 26, 2003

(87) PCT Pub. No.: WO02/068788

PCT Pub. Date: Sep. 6, 2002

(65) Prior Publication Data

US 2004/0131484 A1 Jul. 8, 2004

(30) Foreign Application Priority Data

Feb. 26, 2001 (CN) ..... 01204055 U

(51) Int. Cl.
*F04B 35/04* (2006.01)
*E21B 43/00* (2006.01)
*H02K 33/00* (2006.01)

(52) U.S. Cl. ..... 417/415; 166/68.5; 310/17

(58) Field of Classification Search ..... 417/415; 166/68.5, 369; 310/12, 17
See application file for complete search history.

(56) References Cited

U.S. PATENT DOCUMENTS

| | | | | |
|---|---|---|---|---|
| 2,681,623 | A * | 6/1954 | Kane | 417/399 |
| 4,161,137 | A | 7/1979 | Gaddy | |
| 4,512,149 | A | 4/1985 | Weaver | |
| 4,719,811 | A * | 1/1988 | Lang et al. | 74/89.22 |
| 5,375,657 | A | 12/1994 | Shi et al. | |
| 5,409,356 | A * | 4/1995 | Massie | 417/416 |
| 6,213,722 | B1 | 4/2001 | Raos | |
| 6,749,017 | B1 * | 6/2004 | Lu et al. | 166/53 |

* cited by examiner

*Primary Examiner*—Charles G. Freay
(74) *Attorney, Agent, or Firm*—Barnes & Thornburg LLP

(57) ABSTRACT

The present invention relates to a well pumping unit driven by a linear motor. The well pumping unit includes a slideway support, a linear motor having a motor complex primary and a motor complex secondary, a polished rod chain, a polished rod chain wheel assembly, a bottom support chain wheel, a counterweight chain wheel, a counterweight chain, and a counterweight. The complex secondary, polished rod chain wheel assembly, bottom support chain wheel and counterweight chain wheel are fixed on the slideway support, the complex primary moving along the slideway support. A first end of the polished rod chain is fixed to an upper end of the complex primary and passes over the polished rod chain wheel assembly, with a second end fixed to a polished rod. A lower end of the complex primary is fixed to a first end of the counterweight chain, the counterweight chain passes over the bottom support chain wheel and counterweight chain wheel and is fixed to the counterweight at a second end thereof.

11 Claims, 1 Drawing Sheet

WELL PUMPING UNIT DRIVEN BY LINEAR MOTOR

Figure 1:
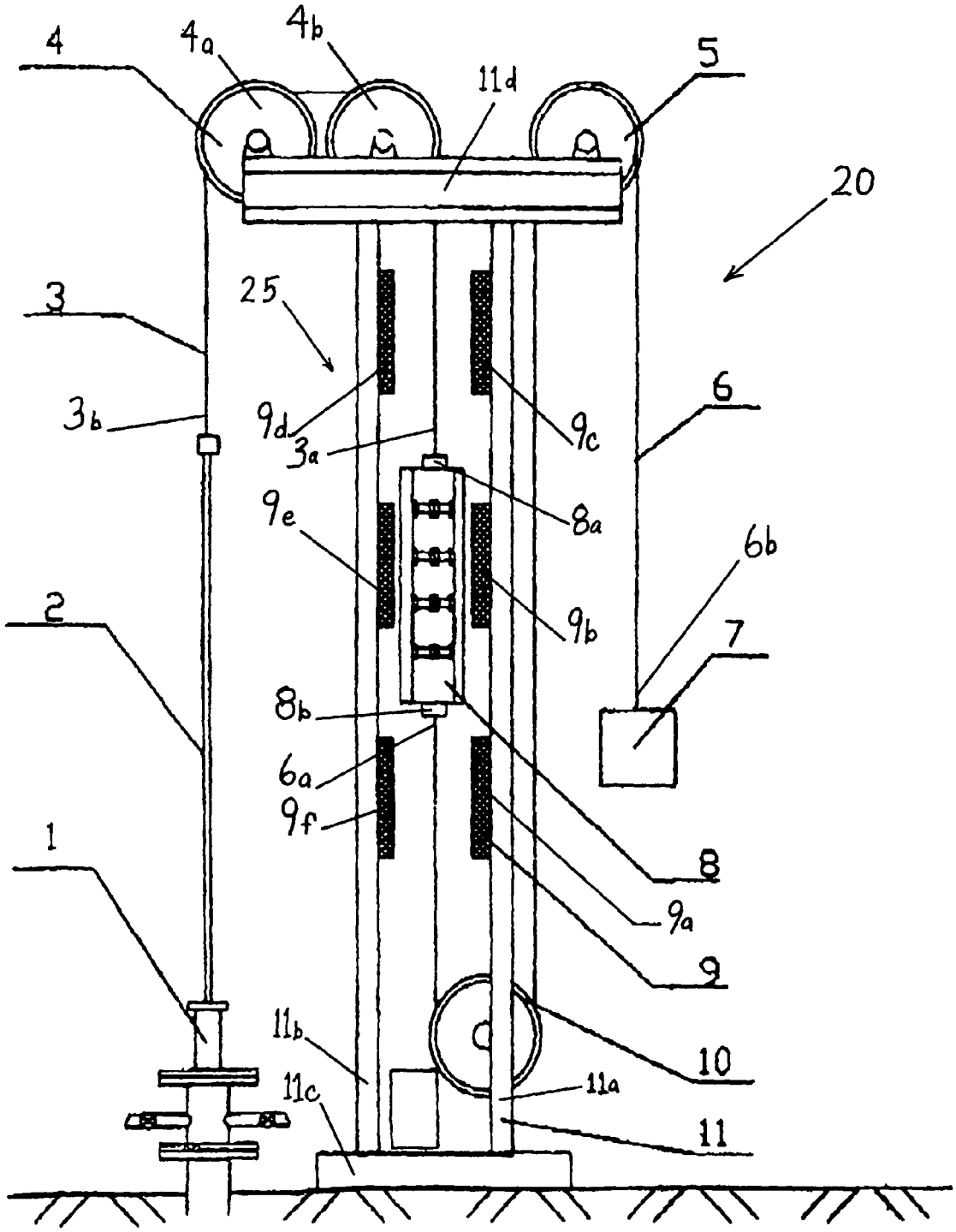

This application claims the benefit of Chinese Application No. 01204055.X filed Feb. 26, 2001.

BACKGROUND OF THE INVENTION

The present invention relates well pumping and more specifically oil well pumping within the oil exploration and collection sector. In particular, the present invention is directed to a well pumping unit wherein the pumping unit is driven by a linear motor.

Traditionally, most well pumping units use motors that produce rotary motion as power for the unit. These units require a reducing gear box and force transforming structure to transform the rotary motion into linear motion to operate the polished rod up and down and thereby operate the pump. These well pumping units require a large and complex body structure and consume large amounts of power.

Chinese ZL Patent No. 96217638.9 (CN 2284867Y filed Jul. 22, 1996) is directed to a well pumping unit driven by a linear motor. This technology adopts a linear motor that links to and drives the polished rod and rod pump, thus removing the gear box and force transforming structure required by units driven by rotary motion. However, the unit's linear motor complex secondary and longitudinal position limiting switches are fixed on the wellhead; positioning blocks are fixed on both ends of the complex primary and slide against the position-limiting post, and the wellhead unit and the position-limiting post are respectively fixed with buffer springs. The complex primary of the linear motor is hollow in structure through which the polished rod passes. The polished rod and its clamping mechanism are fixed on the complex primary of the linear motor. There are counter weight slideway wheels on the support. The clamping mechanism fixed to the complex primary is linked to the counter weight by way of a steel cable that passes over the slideway wheels.

The previous well pumping unit driven by a linear motor, wherein the complex secondary of the linear motor and the position-limiting post are fixed on the wellhead assembly, has some unavoidable drawbacks. First, motion of the linear motor causes vibration in the pumping unit and this is transferred directly to the wellhead unit. Since the complex secondary and the position-limiting post are fixed on the well, the motion of the complex primary makes the wellhead unit vibrate, which weakens the wellhead unit seals and thus causes oil and/or natural gas leakage. When natural gas leakage occurs and the linear motor is directly fixed to the wellhead unit, natural gas can spread directly into the linear motor, which presents a serious risk of explosion. Second, since the linear motor is fixed on the wellhead unit covering the opening part of the well, it makes maintenance of the wellhead unit and downhole components, such as changes of the packing and/or the packing set, difficult. Third, since the linear motor is fixed on the wellhead, and the wellhead unit is linked to the downhole casing pipe, vibration of the motor makes the casing pipe vibrate, which in turn causes the formation to vibrate and the casing pipe to deform. Fourth, since the linear motor is fixed on the wellhead, the wellhead unit cannot withstand large pressure. Thus, if the linear motor is fixed on the wellhead, additional design is required for the wellhead unit to withstand the large pressure, which requires more investment and cost associated with the oil recovery equipment.

It is therefore an object of the present invention to provide a well pumping unit driven by a linear motor that is removed from the wellhead unit, and thus provides an improved well pumping unit that overcomes the drawbacks associated with known pumping units. These and other objects and advantages of the invention will be apparent from the following description, the accompanying drawings and the appended claims.

SUMMARY OF THE INVENTION

The present invention is a well pumping unit driven by a linear motor which is mounted and supported away from an associated wellhead unit. The well pumping unit includes a slideway support including an upper end and a lower end, said lower end mounted on a surface away from the associated wellhead unit. Said slideway support including a counterweight chain wheel, a bottom support chain wheel and a polished rod chain wheel assembly. Said counterweight chain wheel mounted at the upper end of said slideway support opposite the mount surface and adapted to engage and support a cable or chain. Said bottom support chain wheel mounted at the lower end of said slideway support and adapted to engage and support a cable or chain. Said polished rod chain wheel assembly mounted at the upper end of said slideway support opposite said counterweight chain wheel and adapted to engage and support a cable or chain.

The well pumping unit includes a linear motor assembly including a linear motor, a counter weight chain, a counter weight and a polished rod chain. Said linear motor includes a motor complex primary and a motor complex secondary. The motor complex secondary comprises a plurality of field generating electromagnets or windings and is mounted to the slideway support and adapted to interact with the complimentary motor complex primary. The motor complex primary includes an upper end and a lower end and is suspended by a first end of the polished rod chain at the upper end of the motor complex primary in an operable position adjacent to the motor complex secondary. The polished rod chain extends over and is supported by the polished rod chain wheel and is fixed to a polished rod of a wellhead unit at a second end of the polished rod chain. A lower end of the motor complex primary is connected to a first end of the counter weight chain. The counter weight chain extends down from the lower end of the motor complex primary, passes under and engages around the bottom support chain wheel, then extends up and over the counterweight chain wheel and is fixed at a second end of the counterweight chain to the counterweight.

Thus, when the linear motor is operated by application of a sequential electrical power source to the motor complex secondary's windings, the complex primary is made to move up and down whereby the polished rod is also made to move up and down and any vibration in the motor is not transferred to the wellhead unit.

BRIEF DESCRIPTION OF THE DRAWING FIGURES

FIG. 1 is a side plan view of a well pumping unit of the present invention.

DETAILED DESCRIPTION OF THE PREFERRED EMBODIMENTS

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

FIG. 1 shows a well pumping unit 20 constructed according to the present invention. The well pumping unit generally includes a slideway support 11, a linear motor 25, a counter weight 7, a counterweight chain 6, a counterweight chain wheel 5, a bottom support chain wheel 10, a polished rod chain wheel assembly 4 and a polished rod chain 3.

The slideway support 11 comprises a plurality of large, parallel channel beams 11*a* and 11*b*, which are mounted to and extending perpendicular to base 11*c*. The slideway support 11 includes a top support beam 11*d* connecting the channel beams 11*a* and 11*b* at an end opposite the base 11*c*. Cross beams (not shown) optionally connect the channel beams 11*a* and 11*b* along the extent thereof to form a stable frame structure. The frame structure may be welded or fixed by bolts or other suitable means known to those in the art. Also, in order to have a stable structure, channel beams can be replaced by I-shaped steel welded on steel plates.

The slideway support 11 includes a bottom support chain wheel 10 mounted to channel beam 11*a* near the base 11*c* and a counter weight chain wheel 5 mounted to the top support beam 11*d*. A polished rod chain wheel assembly 4 is mounted on the top support beam 11*d* on an end opposite the counterweight chain wheel 5. The polished rod chain wheel assembly 4 is shown comprising two chain wheels 4*a* and 5*b* of approximately 500 mm in diameter, however a skilled artisan will appreciate that a single larger diameter wheel could be used to reach the desired spacing necessary for operation of the well pumping unit.

The linear motor 25 comprises motor complex primary 8 and motor complex secondary 9. The motor complex primary 8 comprises an upper end 8*a* and a lower end 8*b* and operable to receive and be driven by a field produced by the motor complex secondary 9. The linear motor complex secondary 9 comprises a plurality of rectangular electromagnets or windings 9*a–f* fixed on both sides of the slideway support 11. Windings 9*a–c* are fixed on channel beam 11*a* while windings 9*d*-fare fixed in complimentary positions on channel beam 11*b* opposite windings 9*a–c*. A control unit and electrical wiring are well known to those of skill in the art and are not shown for ease of illustrating the novel elements of the present invention. The linear motor is operable by sequentially varying the electrical supply communicated to individual windings 9*a–f* of the motor complex secondary 9, thus varying the magnetic field produced and driving the complimentary motor complex primary 8, as is well known in the art.

The slideway support 11 preferably includes a plurality of slideway rails (not shown) mounted internal to the channel beams 11*a* and 11*b*, and which may be welded with four angle irons (not shown) in the inner part of the slideway support 11. The slideway rails are adapted to control and limit the horizontal motion or horizontal direction of movement of the motor complex primary 8, thereby guaranteeing or maintaining a substantially linear travel path for the motor complex primary 8. The motor complex primary 8 optionally includes eight slideway blocks (not shown) which are operable to engage and slide along the slideway rails (not shown). The eight slideway blocks on the motor complex primary 8 may optionally be replaced by rollers or other suitable wheels and roll along the slideway rails, accomplishing the guiding function.

The motor complex primary lower end 8*b* is connected to a first end 6*a* of the counterweight chain 6. The counterweight chain 6 extends downwardly and passes partially around and engages the bottom support chain wheel 10. By passing partially around the bottom support chain wheel 10, the counterweight chain's 6 direction of travel is 180 degrees different on each side of the bottom support chain wheel 10. From the bottom support chain wheel 10, the counterweight chain 6 extends up toward the top support beam 11*d*, passes over and engages the counterweight chain wheel 5, again changing the direction of travel 180 degrees on each side of the counterweight chain wheel 5. From the counterweight chain wheel 5, the counterweight chain extends downwardly and is affixed to a counterweight 7 at a second end 6*b*. The weight of the counterweight 7 should meet the requirement of the well and selection of such is well within the skill of person of ordinary skill in the art.

The motor complex primary upper end 8*a* is connected to a first end 3*a* of a polished rod chain 3. The polished rod chain extends upwardly from the motor complex primary upper end 8*a* and passes over and engages the polished rod chain wheel assembly 4, thus changing direction of travel by 180 degrees. From the polished rod chain wheel assembly 4, the polished rod chain extends downwardly to a second end 3*b* which is attached to a polished rod 2 of a wellhead unit 1.

The advantages of the present invention include that the upper end of the motor complex primary and the polished rod driven by the linear motor are connected by chains, cables, or other suitable linkage through the polished rod chain wheel assembly. Thus, the wellhead unit and polished rod are separated from the linear motor. Since the well pumping unit (linear motor) is mounted away and separate from the wellhead unit, leaking gas does not directly enter the linear motor so there is less risk of collection and explosion in the motor area. Also, the linear motor is not installed on the wellhead unit so the original wellhead unit can be kept in operation without any significant modification.

The present invention is more convenient than a conventional spin-motor driven, beam-type unit. The control unit of the linear motor allows for push-button set up and the individual adjustment of the length and duration of each stroke that is not possibly with conventional well pumping units that require difficult physical adjustments to the pumping apparatus. Additionally, the vibration of the linear motor will not be transferred to and will not affect the downhole casing pipe of the well, which resolves the problem that the wellhead unit maintains high pressure. The present inventive well pumping unit has few moving parts to fail, therefore the life expectancy of the pumping unit is increased. Further, since no gear box or rotational force transforming apparatus is required, the weight of the present inventive well pumping unit is greatly reduced, thus reducing the cost of transferring and set up between wells. Finally, replacing the previous wellhead mounted support with a slideway support that is mounted on a surface away from the wellhead unit simplifies the pumping unit system driven by a linear motor and eliminates several of the drawbacks.

The present invention will now be illustrated with respect to the following example.

EXAMPLE 1

A energy consumption comparative test evaluating the energy consumption of a conventional beam-type well pumping unit and a well pumping unit driven by a linear motor per the present invention was performed. Data was collected on the Ma-2 Well of the Rendong working area of the Peoples Republic of China. The original well pumping unit was a convention beam-type CYJ10-48-73IIB driven by a conventional rotary force motor $YCY280M_2$-8 with a power rating of 45 (kW) and rated rotation speed of 740 (rpm). The new well pumping unit constructed according to the present invention was ZXCY-1 with a linear motor power rated at 12 (kW). The pumping units were each independently installed on the wellhead to compare the present invention including a linear motor with the conventional pumping unit in terms of energy-saving effect. Testing under working conditions of the well pumping unit driven by a linear motor on effective power (kW) and invalid power (kvar), regular electric parameters of running power factors are shown. The power-saving amount of the well pumping unit driven by a linear motor was calculated according to the oil amount produced by the two types of well pumping units running periodically. Measuring instruments included an electric power meter (HIOKI 3162), a pincer-like power meter (HIOKI 3266), stopwatch (CASIO HS-10W) and a thermohygrograph (6511). The results are depicted in Table 1.

TABLE 1

| Number | Test Item | Working condition of the original well pumping | Working condition of the new well pumping | Test Method |
|---|---|---|---|---|
| 1 | Frequency of supply Hz | Power frequency | Frequency conversion | GB/15316-94 GB/12497-1995 SY/T5268-1996 |
| 2 | Frequency of stroke time/min | 4.00 | 2.54 | |
| 3 | Effective pow(kW) | 10.34 | 4.33 | |
| 4 | Invalid power(kvar) | | 1.18 | |
| 5 | Vision power(kW) | | 4.48 | |
| 6 | Power factor | | 0.965 | |
| | Oil amount | 64.9 | 41.6 | |
| | Power consumption per ton kWh/t | 3.82 | 2.50 | |
| 7 | Electricity-saving rate % | 0.00 | 34.6 | |
| 8 | Temperature, C./moisture %/ wind speed m/s | 26.5~ 27.2/51.4~ 50.3 | /0.13~0.17 | |

Although the preferred embodiment herein was described as having chains and chain wheels, one of ordinary skill in the art will appreciate that pulleys and steel cables or any other suitable connection means could replace the chains and chain wheels without deviating from the scope of the invention. Thus, various features of the invention have been particularly shown and described in connection with the illustrated embodiment of the invention, however, it must be understood that these particular embodiments merely illustrate and that the invention is to be given its fullest interpretation within the terms of the appended claims.

I claim:

1. A well pumping unit driven by a linear motor comprising:

a) a slideway support operable to be mounted on a surface adjacent to a well head, said slideway support including:

i) a first means for engaging and supporting an elongate flexible member, said first means mounted at an upper end of said slideway support;

ii) a second means for engaging and supporting an elongate flexible member, said second means mounted at a lower end of said slideway support; and, iii) a third means for engaging and supporting an elongate flexible member, said third means mounted at the upper end of said slideway support and spaced from said first means, and b) a linear motor assembly supported by said slideway support, said linear motor assembly comprising:

i) a motor complex primary and a motor complex secondary, said motor complex secondary operable to produce a field, said motor complex primary being complementarily manipulated by said field, said motor complex primary having an upper end and a lower end;

ii) a first elongate flexible member, said first elongate flexible member having a first end fixed to said upper end of said motor complex primary, said first elongate flexible member passing over and supported by said first means for engaging and supporting an elongate flexible member, said first elongate flexible member having a second end operable to couple with an associated wellhead unit; and, iii) a second elongate flexible member, said second elongate flexible member having a first end fixed to said lower end of said motor complex primary, said second elongate flexible member passing under and supported by said second means for engaging and supporting an elongate flexible member, said second elongate flexible member passing over and supported by said third means for engaging and supporting an elongate flexible member, said second elongate flexible member having a second end operable to couple with a counterweight.

2. The well pumping unit of claim 1, wherein said first, second and third means for engaging and supporting an elongate flexible member are independently selected from chain wheels or pulleys.

3. The well pumping unit of claim 1, wherein said first and second elongate flexible members are independently selected from the group consisting of chains, cables, ropes, cords, belts, straps and equivalents thereof.

4. The well pumping unit of claim 1, wherein said first means for engaging and supporting an elongate flexible member comprises two means for engaging and supporting an elongate flexible member placed adjacent to one another.

5. The well pumping unit of claim 1, wherein said motor complex secondary comprises a plurality of electromagnet pairs sequentially operable to create a linearly propagating magnetic field.

6. The well pumping unit of claim 5, wherein said motor complex secondary comprises three pairs of electromagnets sequentially operable to create a linearly propagating magnetic field.

7. The well pumping unit of claim 1, further comprising an electrical control unit in electrical communication with said motor complex secondary and operable to sequentially power said motor complex secondary to create a linearly propagating magnetic field.

8. The well pumping unit of claim 1, wherein said slideway support further comprises a means for linearly guiding said motor complex primary.

9. The well pumping unit of claim 8, wherein said means for linearly guiding said motor complex primary comprises a plurality of slideway rails and said complex primary further includes means for engaging said slideway rails.

10. A well pumping unit comprising:

a) a linear motor including a driven member operable to be driven by a magnetic field; and, b) a slideway support operable for mounting adjacent to a wellhead unit and operable to support said linear motor, said slideway support including a first means for tethering a first end of said driven member of said linear motor to said adjacent wellhead unit, said slideway support further including second means for tethering a second end of said driven member of said linear motor to a counter weight.

11. A method of driving a polished rod of a wellhead unit comprising:

a) supporting a linear motor on a surface adjacent to a wellhead unit, said linear motor having a driven member operable in a substantially vertical arrangement, said driven member having a first end and a second end;

b) tethering the first end of said driven member to said polished rod through a first pulley system;

c) tethering the second of said driven member to a counterweight through a second pulley system; and, d) operating said linear motor such that said driven member oscillates up and down, whereby said oscillating causes said polished rod tethered to said driven member to oscillate up and down.

* * * * *